US009194188B2

(12) United States Patent
Hahati et al.

(10) Patent No.: US 9,194,188 B2
(45) Date of Patent: Nov. 24, 2015

(54) ROTARY DRILL AND METHOD FOR THE PRODUCTION THEREOF

(75) Inventors: Abdelhakim Hahati, Brussels (BE); Sebastian Desmette, Thieusies (BE)

(73) Assignee: TERCEL IP LIMITED, Tortola (VG)

( * ) Notice: Subject to any disclaimer, the term of this patent is extended or adjusted under 35 U.S.C. 154(b) by 722 days.

(21) Appl. No.: 13/520,718

(22) PCT Filed: Dec. 31, 2010

(86) PCT No.: PCT/EP2010/007999

§ 371 (c)(1),
(2), (4) Date: Jul. 5, 2012

(87) PCT Pub. No.: WO2011/082821

PCT Pub. Date: Jul. 14, 2011

(65) Prior Publication Data

US 2012/0318584 A1 Dec. 20, 2012

(51) Int. Cl.

| | |
|---|---|
| ***E21B 10/46*** | (2006.01) |
| ***E21B 10/43*** | (2006.01) |
| ***E21B 10/55*** | (2006.01) |

(52) U.S. Cl.

CPC ..... *E21B 10/43* (2013.01); *E21B 10/55* (2013.01)

(58) Field of Classification Search

CPC ..... E21B 10/46; E21B 10/55; E21B 10/43; E21B 10/573; E21B 10/567; E21B 10/62; E21B 10/00; E21B 10/5673

USPC ..... 175/434, 428, 432, 374, 431, 425

See application file for complete search history.

(56) References Cited

U.S. PATENT DOCUMENTS

| | | | | |
|---|---|---|---|---|
| 2,955,810 | A * | 10/1960 | McWhorter et al. | 299/108 |
| 4,991,670 | A * | 2/1991 | Fuller et al. | 175/428 |
| 5,333,699 | A | 8/1994 | Thigpen | |
| 5,558,170 | A * | 9/1996 | Thigpen et al. | 175/57 |
| 6,287,360 | B1 * | 9/2001 | Kembaiyan et al. | 75/240 |
| 7,469,757 | B2 * | 12/2008 | Azar et al. | 175/432 |
| 7,497,280 | B2 * | 3/2009 | Brackin et al. | 175/374 |
| 7,814,997 | B2 * | 10/2010 | Aliko et al. | 175/408 |
| 8,069,936 | B2 * | 12/2011 | Scott et al. | 175/434 |
| 8,100,203 | B2 * | 1/2012 | Lockwood et al. | 175/434 |
| 8,689,910 | B2 * | 4/2014 | Doster | 175/431 |
| 8,757,299 | B2 * | 6/2014 | DiGiovanni et al. | 175/428 |
| 8,943,663 | B2 * | 2/2015 | Overstreet et al. | 29/458 |
| 2002/0125048 | A1 | 9/2002 | Traux | |
| 2005/0103533 | A1 * | 5/2005 | Sherwood et al. | 175/432 |
| 2007/0251732 | A1 * | 11/2007 | Mirchandani et al. | 175/393 |
| 2008/0314645 | A1 | 12/2008 | Hall | |
| 2012/0318584 | A1 * | 12/2012 | Hahati et al. | 175/428 |

FOREIGN PATENT DOCUMENTS

| | | | |
|---|---|---|---|
| GB | 2368359 | A | 5/2002 |
| WO | 2011082821 | A1 | 7/2011 |

OTHER PUBLICATIONS

International Search Report dated Jun. 25, 2012.

* cited by examiner

*Primary Examiner* — Daniel P Stephenson

(74) *Attorney, Agent, or Firm* — Symbus Law Group, LLC; Clifford D. Hyra

(57) ABSTRACT

Rotary rock bit comprising a tool body having an axial core (1) and radial blades (2) made of steel, grooves (6) hollowed out in the edge (5) of the blades, transversely thereto, and cylindrical abrasive elements (8) comprising impregnated diamonds, which are disposed in the grooves, transversely to the blades.

10 Claims, 4 Drawing Sheets

ROTARY DRILL AND METHOD FOR THE PRODUCTION THEREOF

This application claims the benefit of Belgian patent application No. 2010/0006, filed Jan. 5, 2010, which is hereby incorporated by reference in its entirety.

FIELD OF THE INVENTION

The invention relates to rotary rock bits, specifically to rock bits intended for drilling wells in oil or gas fields or for coring in such fields.

The invention relates more particularly to a rotary rock bit of the type comprising a tool body having an axial core and radial blades through which there pass cavities containing abrasive elements comprising impregnated diamonds.

PRIOR ART

Rotary rock bits of the type defined above are commonly used for drilling wells in oil or gas fields.

Document US 2002/0125048 A1 describes a rock bit of the type defined above, in which the body and the blades form a unitary assembly comprising impregnated diamonds, cylindrical cavities that contain abrasive elements comprising impregnated diamonds passing through the blades. Such a drill bit comprises a shank and a crown provided with impregnated diamond blocks. The crown is formed by infiltrating a mass of tungsten carbide into a mold, wherein the mold comprises ridges and other elements to create the sockets for receiving diamond impregnated blocks, and to create the nozzles for allowing the passage of a drilling fluid to clean and cool the crown. In that document, the crown is first formed and then the impregnated diamond blocks are fastened to the sockets of the crown. This manufacturing process minimizes the time of exposition of the diamonds under high temperatures. Alternatively, the crown can be made of steel. The sockets are perpendicular to the crown surface or alternatively inclined relative to the surface of the crown. The impregnated diamonds blocs abrade the rock formation, but those blocs also gradually wears away during the drilling process and a loss of drilling efficiency is observed when the exposed surface of the blocs arrives at the same level than the crown surface.

In the known rock bit which has just been described, a substantial part of the cylindrical abrasive elements is buried in the cavities and is consequently not involved in drilling, this having a disadvantageous effect on the cost of manufacturing the drilling tool, on its effectiveness and on its service life.

SUMMARY OF THE INVENTION

The invention aims to remedy the abovementioned disadvantages of the known rock bits described above.

The invention aims more particularly to provide a rotary rock bit having a novel design, the manufacture of which does not require the use of high temperatures for excessively long periods of time.

Another objective of the invention is to provide a rotary rock bit which is not the seat of internal mechanical stresses that are liable to weaken it and which as a result has enhanced mechanical strength.

An additional objective of the invention is to provide a rock bit that allows more economical use of the abrasive elements and which, as a result, has greater effectiveness and a longer service life.

It is also an objective of the invention to provide rock bits which are suitable for repair and reconditioning after use.

The invention also aims to provide a novel method for manufacturing such a rock bit, said method not requiring a high-temperature heat treatment and, as a result, avoiding the risks of the tool cracking, said risks being inherent to the known method described above.

Consequently, the invention relates to a rotary rock bit comprising a tool body which is of revolution about a rotational axis, said tool body comprising an axial core and radial blades through which there pass cavities containing abrasive elements comprising impregnated diamonds, the rock bit being characterized in that the blades are made of steel, in that the cavities are grooves hollowed out in the edge of the blades, in the direction of rotation of the tool body, and in that the abrasive elements are cylinders which are disposed in the grooves, in the direction of rotation of the tool body.

DETAILED DESCRIPTION OF THE INVENTION

In a manner known per se for known rotary rock bits, the body of the rock bit according to the invention is of revolution and is intended to be equipped with abrasive elements designed to drill wells, for example in oil or gas fields. To this end, the posterior part of the axial core is normally designed to be able to be fixed to a string of pipes that is coupled to a motor.

The blades are normally distributed uniformly at the periphery of the core and cavities containing abrasive elements pass through them. The profile of the blades is not critical to the definition of the invention. They may have planar or spiral faces.

According to a first feature of the invention, the blades are made of steel. The choice of the grade of steel is not critical to the definition of the invention. The suitable steel grade can be determined easily by a person skilled in the art. In practice, and by way of example, the following grades are very suitable: 4145H, 4140, ST52, CK45.

Although not essential to the definition of the invention, the core is preferably also made of steel. The blades can be separate elements welded to the core. However, it is preferred according to the invention that the core and the blades form a monolithic block.

The tool body of the rock bit bears abrasive elements comprising impregnated diamonds. The abrasive elements comprising impregnated diamonds are well known in the mining drilling sector, in particular in oil and gas fields. They form the active tools of the rock bit, cutting out and removing the rock by abrasion. Generally, the abrasive elements are obtained by mixing a diamond-containing powder (to which there may have been added a metal carbide powder, for example tungsten carbide) with a powder of a meltable binder (for example a Cu—Mn brazing material) and by then subjecting the mixture produced to compacting followed by sintering. Information about this technique can be found in document US 2002/0125048A1. According to the invention, the abrasive elements comprising impregnated diamonds are cylinders.

Another feature of the invention resides in the shape and the disposition of the cavities containing the cylindrical abrasive elements. According to the invention, said cavities are grooves which are hollowed out in the edge or rim of the blades and which are oriented transversely with respect thereto, so as to be directed substantially tangentially with respect to the direction of rotation of the tool body. The grooves are advantageously semi-cylindrical, their cross section being preferably circular or oval or elongate. However, the invention also covers polygonal cross sections, for example square, rectangular, hexagonal or octagonal or trapezoidal cross sections.

The abrasive elements of the rock bit according to the invention are cylinders. The cross section of the cylinders is not critical to the definition of the invention. It is preferably circular, oval or elongate. However, the invention also covers polygonal cross sections, for example square, rectangular, hexagonal, octagonal or trapezoidal cross sections. The posterior face of the cylinders is preferably domed and their anterior face is usually planar. In the present document, the term "domed" does not designate just an essentially curved surface (for example a spherical surface or an ovoid surface) but also a surface that comprises one or more planar faces extended by one or more curved faces. The terms "posterior" and "anterior" are defined below.

The cylindrical abrasive elements are each housed in one of the abovementioned grooves in the blades. It is normally preferable for the cross section of the cylinder of the abrasive elements to be compatible with that of the grooves, such that the cylinder is substantially in contact with the entire wall of the groove. Each groove may comprise a single abrasive element. Alternatively, grooves may comprise an alignment of a number of cylindrical abrasive elements side by side. In this variant of the invention, the adjoining faces of the abrasive elements are normally complementary. They are preferably planar. This variant of the invention allows the use of abrasive elements of standard length, thereby making it easier to manufacture the rock bit and reducing its production cost.

The abrasive elements can be fixed in their respective grooves by any appropriate means. They are advantageously brazed in their groove.

In the rock bit according to the invention, the cylinder of the abrasive elements forms a projection that protrudes in front of the edge of the blades. This face forms the front face of the abrasive element with respect to the direction of progression of the rock bit during a drilling operation. In the present document, it is called the "front face".

In a particular embodiment of the rock bit according to the invention, the grooves emerge through a radial face of their blade and the cylinder of the abrasive elements has an end that protrudes in front of said radial face of the blade. This radial face of the blade is normally the one that is located in front of its edge, with respect to the normal direction of rotation of the body of the rock bit about the axis of the core. In the rest of the present document, this face of the blade will be designated the "anterior face" of the blade.

In the rock bit according to the invention, it is advantageous, for technical and economic reasons, for the grooves to be as deep as possible. By definition, the depth of a groove is the dimension thereof transversely to the edge of the blade. To this end, in a preferred embodiment of the rock bit according to the invention, the depth of the grooves is such that the distance between the bottom of said grooves and the core is less than 7 cm, preferably less than 5 cm. In practice, for reasons of safety and mechanical strength of the blade and the tool body, it is advantageous to maintain a sufficient distance between the bottom of the groove and the core, generally at least equal to 0.10 cm. Distances between 0.10 and 2.50 cm are preferred, those between 0.25 and 1.50 cm being especially recommended. This embodiment allows optimum use of the abrasive elements, the blades being eroded and worn progressively as the abrasive elements are worn.

In a variant of the embodiment which has just been described, the face of the abrasive elements, which is normally applied against the bottom of the grooves, is made of a material that has high wear resistance and is designed not to exert abrasion on the rock. In the present document, this face of the abrasive elements is called the "rear face", as opposed to the front face which was defined above. The abovementioned material that has high wear resistance may for example comprise a matrix made of impregnated material which, in contact with the rock, is progressively worn until a polished surface is formed. This variant of the invention aims to avoid destruction of the core in the event of the abrasive elements and the blades being completely used up.

In the embodiment which has just been described, the width of the grooves is usually less than their depth and the cross section of the abrasive elements is elongate. The width of a groove is, by definition, the dimension thereof transversely to its depth and to the direction of rotation of the tool body. In the case of planar blades, the width of the grooves is measured in the axial plane of the blade.

In another particular embodiment of the rock bit according to the invention, the grooves have two substantially planar faces, which are transverse to the edge of the blades and against which two planar longitudinal faces of the abrasive elements are applied. In an advantageous variant of this embodiment, the planar faces of the abrasive elements are connected by two opposite convex faces. One of said convex faces forms the rear face of the abrasive element and is applied against a corresponding concave face that forms the bottom of the groove, while the other convex face of the abrasive element is its front face that forms a protrusion in front of the edge of the blade.

In a first variant of the embodiment which has just been described, the two planar faces of at least some of the grooves are substantially parallel, in the same way as the two planar faces of the abrasive elements that they contain.

In another variant of the embodiment which has just been described, the two planar faces of at least one groove and of the abrasive element which it contains diverge from the bottom of the groove as far as the edge of the blade. This variant of the invention makes it possible to optimize the useful surface of the abrasive elements on the edge of the blades, taking account of the curvature of the blades. In this variant of the invention, the useful surface of the abrasive elements on the edge of the blades is optimized by judiciously combining a distribution of grooves (and abrasive elements) having parallel planar faces and of grooves (and abrasive elements) having diverging planar faces. This optimization must be determined in each particular case by a person skilled in the art, depending on the profile of the blades and their edge.

In an additional embodiment of the rock bit according to the invention, the posterior face of the cylinder of the abrasive elements is applied against the posterior face of its groove. In this embodiment of the rock bit, the posterior faces of the cylinder and of the groove are defined with respect to the normal direction of rotation of the rock bit.

In the embodiment which has just been described, the posterior face of the cylinder is preferably in contact with all of the posterior face of the groove. In a first implementation of this embodiment of the rock bit, the abovementioned posterior faces of the cylinder and of its groove are substantially planar. In another implementation of this embodiment of the rock bit, the abovementioned posterior faces of the cylinder and of its groove are domed, the posterior face of the cylinder being convex and that of the groove being concave.

The rotary rock bit according to the invention is used for drilling all types of wells for various applications. It is very especially suitable for drilling deep wells in oil or gas fields or for coring in such fields.

The invention also relates to an original method for manufacturing a rotary rock bit in accordance with the invention.

Consequently, the invention also relates to a method for manufacturing a rotary rock bit comprising a tool body that comprises an axial core of revolution, radial blades fixed to the core and cylindrical abrasive elements comprising impregnated diamonds that are housed in cavities formed in the blades, the method being characterized in that the core and the blades are manufactured from steel, in that the cavities are grooves that are formed through the peripheral edge of the blades, in the direction of rotation of said tool body, and in that the abrasive elements are cylinders that are inserted into the grooves.

In the method according to the invention, the features of the core, the blades, the grooves and the abrasive elements are identical to those which were defined above in relation to the rock bit according to the invention.

In the method according to the invention, the tool body can be manufactured in a monolithic block incorporating the core and the blades. In a different embodiment, the core and the blades are manufactured separately, and the blades are subsequently fitted to the core, for example by a welding operation. Use is preferably made, according to the invention, of a monolithic block.

In the method according to the invention, use can be made of any appropriate means for forming the grooves in the blades. However, use is preferably made of mechanical machining, which is normally carried out by milling on a machining bed.

In a first embodiment, the grooves are machined in blades not attached to the core, the blades subsequently being fixed to the periphery of the core.

Another embodiment, which is preferred, is applied to monolithic tool bodies, the grooves being machined in blades secured to the core. This embodiment is especially suitable for the manufacture of rock bits in which the posterior face of the grooves is domed. It is applicable very especially to the above-described embodiment in which the grooves emerge through the anterior radial face of their blade and in which the anterior end of the cylinder of the abrasive elements protrudes forward of said anterior radial face of the blade.

As was described above, the manufacture of the abrasive elements comprising impregnated diamonds comprises the compacting of a powder in a cylindrical mould by means of a piston or of a pair of pistons, the compacting being followed by sintering. In the event that abrasive elements having a domed and convex posterior face are desired, the piston of the compacting press has a concave profile, the peripheral edge of which is subjected to intensive wear. In order to avoid this wear and rapid deterioration of the piston, it is proposed, in a particular embodiment of the method according to the invention, that use be made of a piston comprising a planar annular border at the periphery of its concave face.

BRIEF DESCRIPTION OF THE FIGURES

Particular features and details of the invention will become apparent from the following description of the appended figures, which show various particular embodiments of the invention.

The figures are not drawn to scale.

Generally, the same reference numbers designate the same elements.

DETAILED DESCRIPTION OF PARTICULAR EMBODIMENTS

Figure 1:
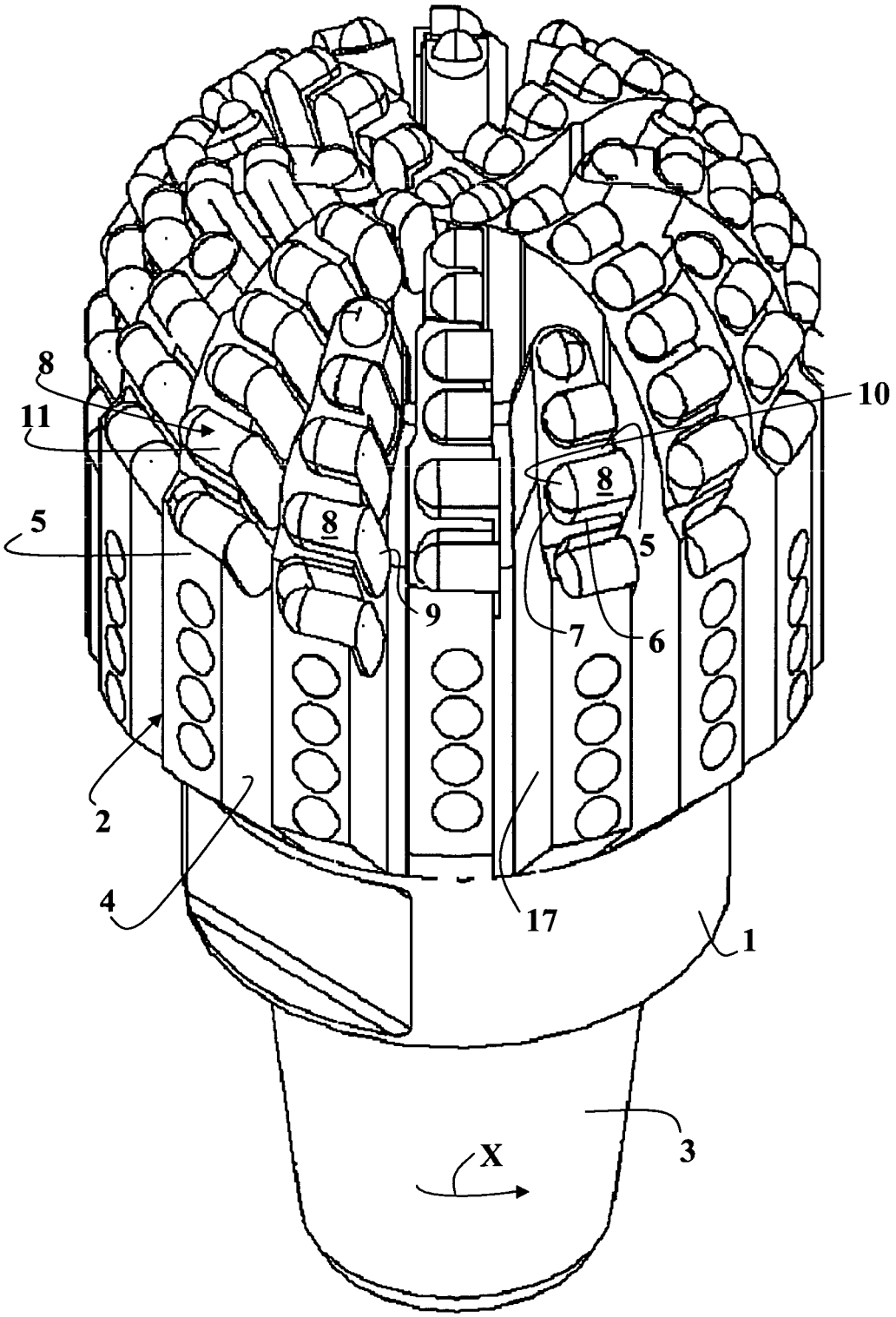
FIG. 1 shows a rock bit in accordance with the invention in perspective.

The rock bit shown in FIG. 1 comprises a tool body incorporating an axial core 1 and radial blades 2 fixed to the periphery of the core 1. The core 1 is extended by a threaded end piece 3 intended to fix it to a string of pipes (not shown) of a drilling or coring installation. The radial blades 2 are distributed uniformly at the periphery of the core 1. They each have, in a conventional manner, two planar radial faces 4 and 17 and an edge 5 connecting the two radial faces. The radial face 4 of the blade 2 is in front of its edge 5 with respect to the normal direction of rotation X of the rock bit. It is, by definition, the anterior face 4 of the blade 2. The radial face 17, which is located behind the edge 5 of the blade with respect to the normal direction of rotation X of the rock bit, is, by definition, its posterior radial face 17.

In accordance with the invention, the core 1, the threaded end piece 3 and the blades 2 form a monolithic assembly or block made of steel.

Cavities 6 pass through the blades. The cavities 6 are grooves which are hollowed out in the edge 5 of the blades, transversely to the radial faces 4 and 17. The grooves 6 pass through the anterior radial face 4 and their posterior end 7, located close to the radial face 17, is concave (FIG. 8).

Figure 7:
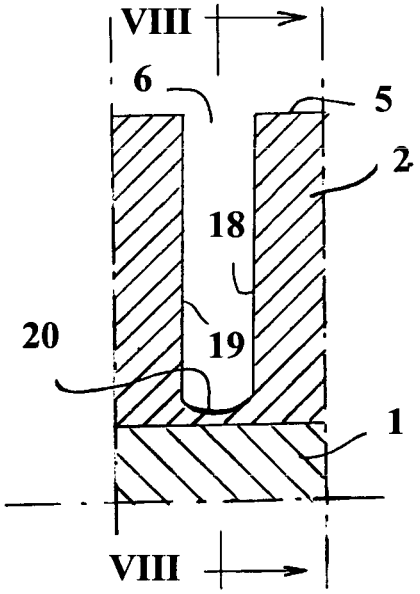
FIG. 7 shows, on a large scale, a cavity in a blade of the rock bit from FIG. 1, in section along the axial plane of the rock bit.
Figure 8:
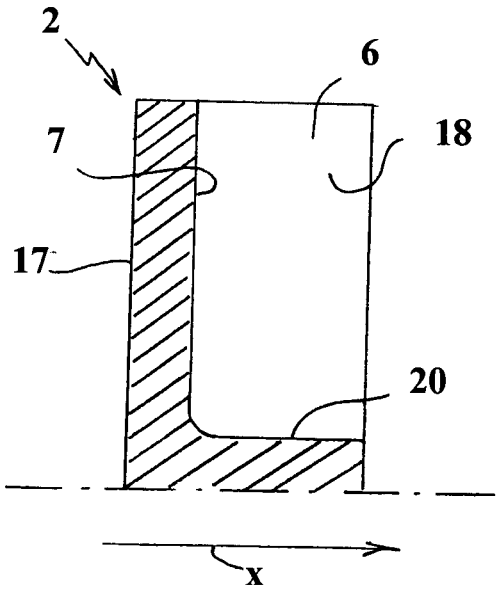
FIG. 8 is a cross section along the plane VIII-VIII in FIG. 7.

FIGS. 7 and 8 show a groove 6 on a large scale. The groove 6 comprises two parallel planar faces 18 and 19 and a concave bottom 20. The concave bottom 20 is located at a short distance from the core 1. The distance between the core 1 and the bottom 20 of the groove is, for example, between 0.5 and 0.75 cm. The depth of the groove 6 is the distance between its bottom 20 and the edge 5 of the blade. The width of the groove 6 is the distance separating its two planar faces 18 and 19. In the rock bit in FIGS. 1, 7 and 8, the grooves 6 are deeper than they are wide.

The grooves 6 each contain an abrasive element 8 (not shown in FIGS. 7 and 8). The abrasive elements 8 are of the type having impregnated diamonds, defined above. They are obtained by a method comprising the compacting of a diamond-containing powder containing tungsten carbide (to which cobalt carbide may have been added) and a powder of a Cu—Mn brazing material, the compacted powder obtained then being sintered under an inert atmosphere (for example under argon) or a reducing atmosphere. Use is advantageously made of the hot isostatic pressing (HIP) technique.

Figure 2:
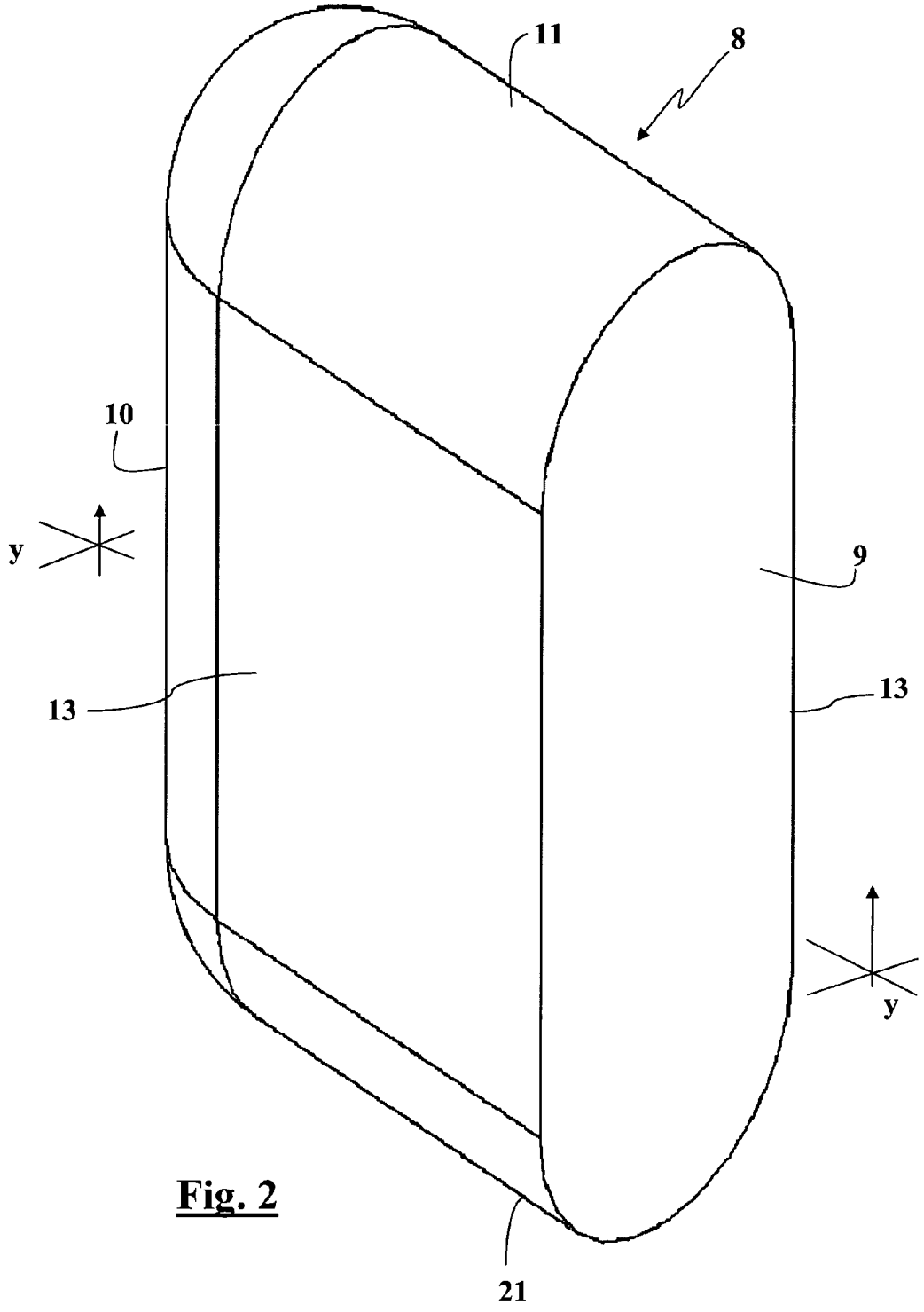
FIG. 2 is a perspective view of an abrasive element of the rock bit from FIG. 1.

An abrasive element 8 is shown on a large scale in FIG. 2. It has an elongate profile, having a substantially planar anterior face 9, a convex posterior face 10 and two planar and parallel side faces 13. The convex face 10 corresponds to the concave posterior face 7 of the grooves 6. The adjectives "anterior" and "posterior" are defined with respect to the direction of rotation X of the rock bit, as described above.

When the abrasive elements 8 are inserted in their respective grooves 6, their side faces 13 are applied against the side faces 18 and 19 of the groove, their domed posterior face 10 is applied against the corresponding domed posterior face 7 of the groove and their lower or rear face 21 is applied against the bottom 20 of the groove. It is desirable for the convex faces 10 and 21 of the abrasive element 8 to be in contact with the concave faces 7 and 20 of the groove 6 over their entire surface. The anterior face 9 of the abrasive elements 8 protrudes forward from the anterior face 4 of the groove and its face 11 forms a projection that protrudes forward from the edge 5 of the blade 2 and forms the front face of the abrasive element 8. The abrasive elements 8 rest on the bottom 20 of the grooves 6, to which they are secured by means of a brazing material. Their convex posterior face 10 may optionally be brazed to the corresponding concave posterior face 7 of the groove 6.

The rear face 21 of the abrasive element 8 is intended to be applied against the bottom 20 of the groove. It is made of a material that has high wear resistance but does not exert an abrasive action on the rock. This material is generally a matrix made of impregnated material which, in contact with the rock, is worn progressively until a polished surface is formed. It may be a plate attached to the abrasive element. Alternatively, it is preferred for the matrix of impregnated material to be an integral part of the abrasive element 8, in which it forms all of the domed rear part 21.

FIGS. 3 to 6 show four particular profiles of the domed posterior face 10 of the abrasive elements 8.

Figure 3:
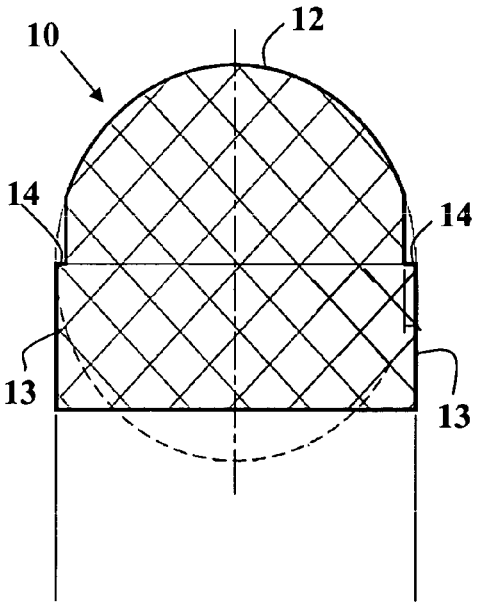
FIGS. 3 to 6 show four particular embodiments of a detail of the abrasive element from FIG. 2, in a cross section along the plane Y-Y in FIG. 2.

The posterior face 10 of the abrasive element in FIG. 3 has a circular cylindrical part 12 which is connected to the planar side faces 13 of the element by two projections 14. These two projections 14 are the result of the tooling used for compacting the diamond-containing powder during the manufacture of the abrasive element. More particularly, the compacting was carried out in a tubular press by means of a piston, the concave profile of which comprises a planar annular border at its periphery.

Figure 4:
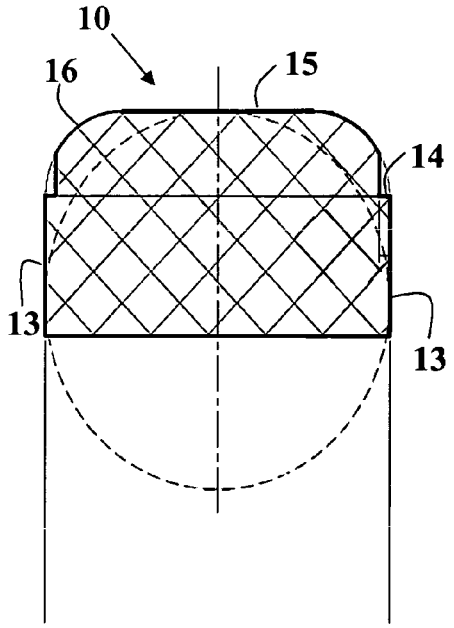

In FIG. 4, the posterior face 10 of the abrasive element 8 has a planar face 15 which is connected to the two planar faces 13 by two curved faces 16 and the two steps 14 described above.

Figure 5:
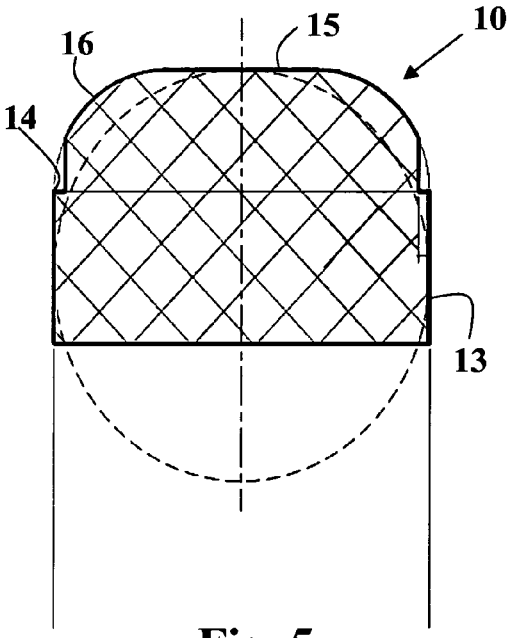
Figure 6:
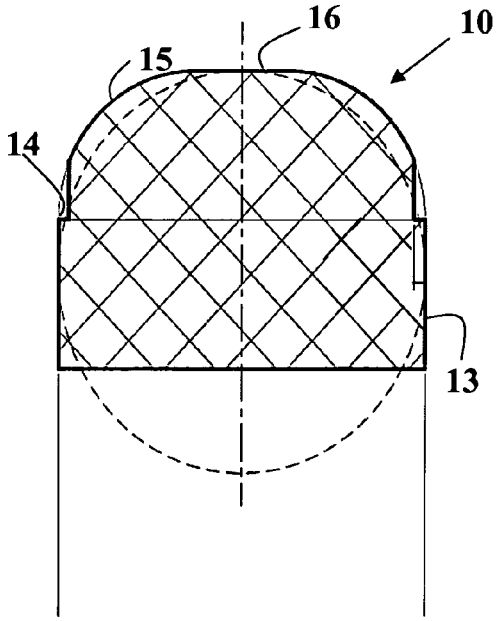

FIGS. 5 and 6 show variants of the embodiment in FIG. 4. In these two figures, the curved faces 16 have larger radii of curvature than in FIG. 4, thereby reducing the size of the planar face 15.

The posterior face 7 of the grooves 6 must have a profile complementary to that of the posterior face 10 of the abrasive element 8. In the case of the abrasive elements in FIGS. 3 to 6, the posterior face 7 of the grooves 6 is generally obtained by machining by means of a milling cutter which is positioned and moved in a suitable manner in the groove 6.

The invention claimed is:

1. A rotary rock bit comprising a tool body which is of revolution about a rotational axis, said tool body comprising an axial core and radial blades through which there pass cavities containing abrasive elements comprising impregnated diamonds, wherein the blades are made of steel, the cavities are grooves hollowed out in the edge of the blades, in the direction of rotation of the tool body, and the abrasive elements are cylinders which are disposed in the grooves, in the direction of rotation of the tool body;

wherein the grooves have two substantially planar faces, which are transverse to the edge of the blades and against which two planar longitudinal faces of the abrasive elements are applied;

wherein the planar faces of the abrasive elements are connected by two opposite convex faces, one of said convex faces being applied against the concave bottom of the groove and the other convex face of the abrasive element forming a forward protrusion from the edge of the blade.

2. The rock bit according to claim 1, characterized in that the abrasive elements form projections that protrude forward from the edge of the blades.

3. The rock bit according to claim 2, characterized in that the depth of the grooves is such that the distance between the bottom of said grooves and the core is less than 7 cm.

4. The rock bit according to claim 3, characterized in that the distance between the bottom of said grooves and the core is substantially between 0.25 and 1.5 cm.

5. The rock bit according to claim 1, characterized in that the grooves emerge through an anterior radial face of their blade and the cylinder of the abrasive elements has an end that protrudes in front of said anterior radial face of the blade.

6. The rock bit according to claim 5, characterized in that a posterior face of the cylinder is convex and is applied against a posterior face of the groove, which is concave.

7. The rock bit according to claim 1, characterized in that a face of the abrasive elements, which is normally applied against the bottom of the grooves, is made of a material that has high wear resistance and is designed not to exert abrasion on the rock.

8. The rock bit according to claim 1, characterized in that the width of the grooves is less than their depth, and in that the cross section of the abrasive elements is elongate.

9. The rock bit according to claim 1, characterized in that the two planar faces of at least one groove and the two planar faces of the abrasive element which it contains diverge from the bottom of the groove as far as the edge of the blade.

10. The rock bit according to claim 1, characterized in that the blades and the core of the tool body form a monolithic assembly.

* * * * *